US006709764B1

(12) United States Patent
Perrin et al.

(10) Patent No.: US 6,709,764 B1
(45) Date of Patent: Mar. 23, 2004

(54) DECORATIVE PAPER SHEET AND DECORATIVE LAMINATE COMPRISING SAME

(75) Inventors: Claude Perrin, Apprieu (FR); Jean-Yves Godet, Pezou (FR)

(73) Assignee: Arjo Wiggins, Issy-les-Moulineaux (FR)

( * ) Notice: Subject to any disclaimer, the term of this patent is extended or adjusted under 35 U.S.C. 154(b) by 0 days.

(21) Appl. No.: 09/355,320

(22) PCT Filed: Jul. 27, 1998

(86) PCT No.: PCT/FR98/01650

§ 371 (c)(1), (2), (4) Date: Oct. 1, 1999

(87) PCT Pub. No.: WO99/28554

PCT Pub. Date: Jun. 10, 1999

(30) Foreign Application Priority Data

Dec. 2, 1997 (FR) ..... 97 15171

(51) Int. Cl.[7] ..... B32B 23/08

(52) U.S. Cl. ..... 428/537.5; 428/511; 428/194; 427/393

(58) Field of Search ..... 428/511, 537.5, 428/194; 427/393

(56) References Cited

U.S. PATENT DOCUMENTS

| | | | | |
|---|---|---|---|---|
| 2,943,013 A | | 6/1960 | Arledter | 162/157 |
| 4,458,062 A | | 7/1984 | Blasing et al. | 528/254 |
| 4,888,220 A | * | 12/1989 | Mehta | 428/15 |
| 4,898,788 A | * | 2/1990 | Minami et al. | 428/481 |
| 5,213,883 A | | 5/1993 | Mehta | 482/224 |
| 5,252,378 A | * | 10/1993 | Mehta et al. | 428/195 |

FOREIGN PATENT DOCUMENTS

| | | |
|---|---|---|
| EP | 0 677 401 A | 10/1995 |

* cited by examiner

*Primary Examiner*—Cynthia H. Kelly
*Assistant Examiner*—L. Ferguson
(74) *Attorney, Agent, or Firm*—Bacon & Thomas

(57) ABSTRACT

The invention relates to a decorative paper sheet, made impregnable by a thermosetting resin, characterized in that it comprises one or more polymers making the 60-second Cobb water absorption value of the sheet, determined according to the ISO 535 standard, at most 40% less than the grammage of the said sheet.

It also relates to a decorative sheet impregnated with a thermosetting resin and the laminated decorative panels or moulded section which include it.

The invention also relates to a process for manufacturing the sheets as well as to the decorative sheets impregnated with a thermosetting resin.

37 Claims, No Drawings

DECORATIVE PAPER SHEET AND DECORATIVE LAMINATE COMPRISING SAME

The invention relates to a decorative paper sheet made impregnable by a thermosetting resin. This sheet is used in the manufacture of laminated decorative panels or moulded section. The invention also relates to the decorative sheets impregnated with a thermosetting resin as well as to the laminated decorative panels or moulded section which include it, and to the processes for manufacturing the sheets.

Laminated decorative panels or moulded section (also called "laminates") have been used for many years as materials in dwellings and in commercial and industrial premises. Typical applications of such laminates are coverings for furniture, tabletops, chairs and other articles or floor coverings such as, in particular, coverings imitating a parquet floor.

There are two main types of decorative "laminates", namely so-called high-pressure "laminates" and so-called low-pressure "laminates".

The so-called high-pressure decorative laminates are produced from a core consisting of resin-impregnated sheets. These sheets are generally made of kraft paper and have been impregnated with a thermosetting resin, usually a phenolic resin.

After the sheets have been impregnated with resin, they are dried, cut and then stacked on top of one another. The number of sheets in the stack depends on the applications and varies between three and nine, but may be greater than this.

Next, the stack of sheets forming the core is placed on a decorative sheet. In general, a protective covering sheet, called an "overlay", devoid of any pattern and transparent in the final laminate, is placed on top of the decorative sheet in order to improve the abrasion resistance of the laminate.

Next, the impregnated sheets are placed in a laminating press, the platens of which are provided with a metal sheet giving the laminate its surface finish. The stack is then densified by heating, at a temperature of about 110° C. to 170° C., and by pressing, at a pressure of about 5.5 MPa to 11 MPa, for approximately 25 to 60 minutes in order to obtain a unitary structure.

Next, this structure is fixed to a base support, for example by adhesively bonding it to the said support, such as a particleboard, especially a wood chipboard.

The so-called low-pressure decorative laminates are produced using only a decorative sheet impregnated with thermosetting resin, and optionally an overlay sheet, which are laminated directly to the base support such as a board during a short cycle, the temperature being about 160 to 170° C. and the pressure 1.25 MPa to 3 MPa.

The impregnable decorative sheet used for the manufacture of laminates is generally a sheet of paper produced on a papermaking machine and which includes cellulose fibres and optionally synthetic fibres, the cellulose fibres being split between from 40 to 100%, preferably from 80 to 100%, by weight of short fibres and from 0 to 60%, preferably from 0 to 20%, by weight of long fibres, from 0.2 to 1%, preferably from 0.4 to 0.5%, by dry weight with respect to the sheet of a wet-strength agent and from 5 to 50% by dry weight with respect to the sheet of decorative particles, for example iridescent pigments, and/or of pigmentary colorants or organic dyes, and/or of opacifying fillers such as titanium dioxide, especially of the rutile type, the said opacifying filler such as titanium dioxide being in quantities of preferably at least 15% and generally between approximately 15 and 40% with respect to the weight of the sheet. It may also contain other additives usually employed in papermaking and, in particular, retention agents or specific agents such as alkaline products allowing characteristics such as post-forming to be controlled.

These decorative sheets do not include a sizing agent, nor are subjected to any surface treatment, as they must be highly absorbent with respect to the thermosetting resin with which they will be impregnated.

Moreover, a decoration may be printed on this sheet, for example a decoration imitating wood or any other fancy decoration.

Next, this sheet is impregnated with a thermosetting, but thermally stable (non-yellowing), resin, usually with melamine-formaldehyde resins or urea-formaldehyde resins, or sometimes with benzoguanamine-formaldehyde resins or unsaturated polyester resins. In a second step, the impregnated sheet is heated and the resin is partially crosslinked (thermally cured) so that the resin is no longer in a tacky state and the sheet can be handled. Such a decorative sheet impregnated with partially cured resin is called, in the art, "decoration film" or "decorative film" or "melamine-resin film".

This second step is generally carried out by heating the sheet at temperatures of approximately 110 to 140° C. and is controlled, so that the resin during the final lamination of the decoration film flows correctly into the sheet, by measuring the content of volatiles remaining in the decoration film since the latter then includes a certain percentage—about 5 to 8%—of volatile products (water, being the solvent for the resin, water resulting from the chemical condensation of the resin, residual formaldehyde, other residual products, etc). These volatiles represent compounds which will be removed during the complete curing of the resin, during the lamination of the decoration film.

The resin, once it has been thermally cured completely, will provide, after lamination, the surface resistance of the final laminate (abrasion resistance, resistance to soiling, to steam and to chemicals, such as solvents, acids and bases, etc).

Moreover, this sheet, once laminated, must have a very high degree of lightfastness since it is exposed almost permanently to light radiation because of its use as a surface covering; the compounds of which it is composed must therefore be selected so as to obtain this lightfastness, which is preferably greater than or equal to 6 on the scale of blues according to the ISO 4586-2.16 standard.

In addition, this sheet must allow an opaque decoration film to be obtained after lamination since it is important not to be able to see, through the said sheet, the base support and/or the sheets of kraft paper on which the impregnated decorative sheet has been laminated, so that there is no interference with the decoration of the sheet. It is therefore necessary to have a decorative sheet which is as opaque as possible.

In the case of a white decoration, for which a very white opacifying filler such as titanium dioxide is used, one is then forced to use large quantities (approximately 40% by weight with respect to the sheet) of fillers such as titanium dioxide in order to obtain this opacity. In fact, after impregnation and lamination, it is only the titanium dioxide which provides the opacity since, because cellulose has a refractive index close to that of the resin, the cellulose fibres are rendered transparent, this being all the more so the greater the amount of resin.

It is therefore necessary to incorporate as much filler, such as titanium dioxide, as possible, but this is expensive and degrades the mechanical properties of the sheet.

In order to reduce the cost of the decoration film, it is sought to minimize the amount of resin absorbed by the sheet while still maintaining the mechanical and surface-resistance properties of the decorative laminate that the thermally cured resin gives it.

This problem is especially important in the case of low-pressure laminated decorative panels or moulded section since the impregnated decorative sheet is directly laminated to the support board.

In Patent Application EP 677,401, these problems were dealt with by proposing a decorative sheet which includes a sizing agent and by preferably creating a thermosetting-resin absorption gradient so that the upper part of the sheet is richer in resin than the lower part internal to the laminate. The sizing agent, because of its hydrophobic effect, prevents the impregnation resin from completely penetrating into the sheet. The sizing agent is added in the bulk or to the surface, and in a differential manner, or by forming two plies, the lower ply having the sizing agent.

However, it has been noted that this latter approach is difficult to implement, does not always allow uniform flow of the resin into the sheet and can lead to defects in the appearance of the laminated decorative panel, especially in the case of low-pressure laminated decorative panels.

The invention aims to solve these problems and the object of the invention is therefore to provide a decorative paper sheet that can be used in decorative laminates, the said sheet resulting in a high opacity of the final decorative laminate and allowing a decorative laminate to be obtained without any defects in its appearance.

The Applicant has found that the object of the invention is achieved if the paper sheet has a 60-second Cobb water absorption value or $COBB_{60}$, determined according to the ISO 535 standard, of less than the grammage of the said sheet by at most 40%, whereas the sheets according to the prior art and without a sizing agent, these being composed almost essentially of cellulose fibres, always have a 60-second Cobb water absorption value equal to or greater than their grammage.

Thus, it seems that the wettability of the sheet is maintained and therefore that the thermosetting resin is distributed uniformly in the sheet and, moreover, that the capacity of the sheet to absorb a thermosetting resin is reduced.

More specifically, the invention provides a decorative paper sheet, made impregnable by a thermosetting resin, comprising from 5 to 50% by dry weight with respect to the sheet of decorative particles and/or of pigmentary colorants or organic dyes and/or of opacifying fillers, particularly titanium dioxide, characterized in that the 60-second Cobb water absorption value of the said sheet, determined according to the ISO 535 standard (water, 1 minute, 23° C.) is less than the grammage of the said sheet by at most 40% and, more particularly, by at least 5%.

Preferably, the $COBB6_0$ value is from 10 to 35% less than the grammage of the said sheet.

In one advantageous embodiment, the sheet comprises a composition of at least one polymer having a hydrophilic character. The hydrophilic character of the composition may stem from the chemical nature of a said polymer itself or from emulsifying agents when the said polymer is a water-insoluble polymer used in the form of an aqueous dispersion.

The hydrophilic character of the said composition or of the said polymer is therefore controlled (neither too high, nor too low) so as to reduce the 60-second Cobb water absorption value so as to be within the abovementioned limits, namely a reduction of at most 40% with respect to the grammage of the said sheet.

The hydrophilic character of the said composition or of the said polymer also makes it possible to reduce the 60-second Cobb water absorption value of the sheet, determined according to the ISO 535 standard (water, 1 minute, 23° C.), and to do so by at most 35% with respect to the 60-second Cobb water absorption value of the same sheet not containing the said composition, and preferably by at least 5%.

The present invention therefore also provides a decorative paper sheet, made impregnable by a thermosetting resin, comprising from 5 to 50% of decorative particles and/or of pigmentary colorants and/or organic dyes or of opacifying fillers, particularly titanium dioxide, by dry weight with respect to the sheet, characterized in that it comprises a composition of at least one polymer having a hydrophilic character and the 60-second Cobb water absorption value of the sheet, determined according to the ISO 535 standard, is at most 35% less than the 60-second Cobb water absorption value of the same sheet not containing said polymer(s).

Preferably, the grammage of the sheet containing the said polymeric composition is from 50 to 150 $g/m^2$, preferably from 60 to 100 $g/m^2$.

According to a particular case, the sheet comprises from 4 to 20% by weight of said polymer(s) with respect to the sheet, especially from 2 to 10 $g/m^2$ by dry weight of said polymer(s).

Preferably, the said composition comprises a water-insoluble polymer in aqueous dispersion.

Also preferably, the said water-insoluble polymer is a polymer having a hydrophilic character. As water-insoluble polymer having a hydrophilic character, mention may be made of polymers chosen from vinyl acetate polymers and particularly vinyl acetate/butyl acetate copolymers, vinyl acetate/ethylene copolymers or acrylic ester copolymers, particularly ethyl acetate/acrylonitrile/methacrylate copolymers, or else blends thereof. Other water-insoluble polymers having a hydrophilic character, which are known as binders, although according to the invention these do not involve the desired technical effect, may be compatible with the application according to the present invention, especially if they do not impair the good lightfastness of the decorative laminate, this preferably being greater than or equal to 6 on the scale of blues according to the ISO 4586-2.16 standard.

A polymeric composition comprising, as a mixture, an aqueous dispersion of a water-insoluble polymer and an aqueous solution of a water-soluble polymer, especially a poly(vinyl alcohol) polymer, may also be used.

More particularly, the composition may comprise from 80 to 95% by dry weight of a water-insoluble polymer and from 5 to 20% by dry weight of water-soluble polymer. The said water-soluble polymer may help to improve the uniformity in the appearance and in the steam resistance of the final panel and to reduce the time required to impregnate the sheet with the thermosetting resin.

The said polymer is advantageously introduced into the sheet by an impregnation process, especially using a size press containing the said polymer in aqueous medium. Any other means of application allowing good penetration of the film by the polymer may also be employed. The treatment composition may also contain standard papermaking additives, especially viscosity-control agents and antifoam agents.

The solids content and the viscosity of the composition may be controlled by those skilled in the art depending on the means of application used and on the amount of the said polymer to be introduced into the sheet.

Optionally, the said polymer may be added, in the bulk, in the pulp chest of a papermaking machine.

Preferably, the opacifying fillers are titanium dioxide pigments and are present in an amount ranging from 20 to 45%, more particularly from 30 to 40% by dry weight of the sheet. Other white fillers may be used, such as kaolin or talc, either as a complement to the titanium dioxide or as a mixture with pigmentary colorants.

In one embodiment, the sheet of paper according to the invention comprises:

cellulose fibres and, optionally, synthetic fibres, the cellulose fibres being split between from 40 to 100%, preferably from 80 to 100%, by weight of short fibres and from 0 to 60%, preferably from 0 to 20%, by weight of long fibres, from 0.2 to 1%, preferably from 0.4 to 0.5%, by dry weight with respect to the weight of the sheet of a wet-strength agent.

The invention also provides a decorative paper sheet impregnated with a partially crosslinked thermosetting resin (decoration film) which is characterized in that it includes the said decorative sheet with the said polymer and that it contains at most 50% and preferably at least 40%, even more preferably at least 45%, by weight of thermosetting resin with respect to the weight of the resin-impregnated sheet, volatile compounds included.

The impregnated decorative sheet according to the invention may also be characterized in that it contains at most 50% and preferably at least 40%, even more preferably at least 45%, by weight of thermosetting resin with respect to the weight of the resin-impregnated sheet, volatile compounds included, and an amount of titanium dioxide of less than 40%, preferably less than 35%, by dry weight of the sheet and having an opacity identical to that of a decorative sheet of the same grammage before impregnation by the said resin, and containing an amount of titanium dioxide of at least 40% by dry weight of the sheet and more than 50% of said resin with respect to the weight of the resin-impregnated sheet, volatile compounds included.

In particular, the thermosetting resin is chosen from among melamine-formaldehyde resins and urea-formaldehyde resins or from among benzoguanamine-formaldehyde resins and unsaturated polyester resins, or blends thereof.

The subject of the present invention is also a process for manufacturing, by wet route, the said decorative sheet, which is characterized in that it comprises the following steps:

a sheet is formed on a papermaking machine from an aqueous suspension of cellulose fibres and, optionally, of synthetic fibres, and from 5 to 50% by dry weight with respect to the sheet of decorative particles and/or of pigmentary colorants or organic dyes and/or of opacifying fillers, particularly titanium dioxide, and optionally of other additives usually employed in these sheets, it is drained and, optionally, dried, the sheet formed is impregnated, using a size press, with a composition in aqueous medium containing one or more of the said polymers, the sheet is drained and dried.

According to one particular case, the process comprises the following steps:

a sheet is formed on a papermaking machine from an aqueous suspension of cellulose fibres and optionally of synthetic fibres, these fibres being split between from 40 to 100%, preferably from 80 to 100%, of short fibres and from 0 to 60%, preferably from 0 to 20%, of long fibres, from 0.2 to 1%, preferably from 0.4 to 0.5%, by dry weight with respect to the sheet of a wet-strength agent and from 5 to 50% by dry weight with respect to the sheet of decorative particles and/or of pigmentary colorants or organic dyes and/or of opacifying fillers, particularly titanium dioxide, and optionally of other additives usually employed in these sheets, it is drained and, optionally, dried, the sheet formed is impregnated, using a size press, with from 4 to 20% by dry weight, especially from 2 to 10 g/m$^2$ by dry weight, with respect to the sheet of a composition in aqueous medium containing one or more of the said polymers, the solids content of the composition being especially between 5 and 20% by weight, the sheet is drained and dried.

In one particular case, the invention also provides a process for manufacturing a decorative sheet impregnated with a partially crosslinked thermosetting resin (decorative film) which is characterized in that a paper sheet as described above is used, in that the said sheet is impregnated with a thermosetting resin and in that the resin is partially crosslinked, the content of volatile compounds being between 5 and 8% by weight of the sheet.

The subject of the invention is also a laminated decorative panel or profile which is characterized in that it includes, as decorative sheet, a sheet as described above.

In particular, this laminated decorative panel or profile is a low-pressure laminate which may be produced conventionally, as described in the introduction.

The invention therefore makes it possible to reduce the thermosetting-resin requirement and to improve the opacity of the decoration film, while maintaining satisfactory properties in the final laminate as the following non-limiting examples demonstrate:

EXAMPLES

Comparative Control Example 1

Step 1: A control paper sheet is produced according to the prior art:

A sheet of paper is produced on a Fourdrinier-type papermaking machine by mixing, in the bulk, into a suspension of cellulose fibres in aqueous medium, 0.5% with respect to the sheet of a wet-strength agent (a polyamide-polyamine-epichlorohydrin resin) and titanium dioxide pigments in quantities such that they are present in the paper in an amount of approximately 40%. The titanium dioxide content is determined by the 800° C. ash content, the titanium dioxide being the only inorganic, and therefore incombustible, compound in the paper, apart from the residues in the pulp (in very small amounts).

The sheet is formed and dried.

Step 2: Using a laboratory impregnating device, the sheet is impregnated with a mixture of thermosetting resins (urea-formaldehyde and melamine-formaldehyde resins) in aqueous solution. Next, the resin is partially crosslinked (thermally cured) in order to obtain a resin with a volatile compound content of 6.5% by weight.

The volatiles content is determined by heating the resin-impregnated sheet at 160° C. for five minutes; it corresponds to the ratio of the difference between the weight of the sheet before entering the oven and its weight after leaving the oven to the weight of the sheet before entering the oven.

Step 3: A laminate is produced in the laboratory by applying the sheet obtained to a particleboard and by subjecting the assembly to a temperature of 180° C. for one minute at a pressure of 2.5 MPa.

Comparative Example 2

Step 1: A sheet of paper based on step 1 of Example 1 is repeated, but by impregnating it in a size press with an aqueous composition which includes a polymer having a hydrophobic character, used in the form of a stable aqueous dispersion. This is a butyl acrylate/styrene copolymer. The solids content of this composition is 10% by weight.

The sheet is dried.

Steps 2 and 3 are carried out as in Example 1.

When carrying out step 2, of impregnating the sheet with the thermosetting resin, the impregnation is poor and after step 3 it is found that the laminate obtained has a spotted appearance.

The 60-second Cobb water absorption value of the sheet drops from 73 g/m$^2$ to 29 g/m$^2$, i.e. a 60% reduction; it is markedly less than that of the control sheet and is therefore too low for the sheet to be correctly impregnated and to allow decorative panels to be produced with a correct appearance.

Example 3

Step 1: A sheet of paper based on step 1 of Example 1 is repeated, but by impregnating it in a size press with an aqueous composition which includes a mixture of an aqueous dispersion of a water-insoluble polymer having a hydrophilic character, known as a binder, and of a poly(vinyl alcohol) solution. The water-insoluble polymer is a vinyl acetate/ethylene copolymer. The solids content of this composition is 10% by weight. The solids content of this composition comprises 10% by weight of the said water-soluble polymer and 90% by weight of the said water-insoluble polymer.

The sheet is dried.

Step 2, of impregnation with the thermosetting resin, and step 3, of lamination, are then carried out as in Example 1.

Example 4

Step 1: A sheet of paper based on step 1 of Example 1 is repeated, but by impregnating it in a size press with an aqueous composition which includes a polymer having a hydrophilic character, known as a binder, used in the form of a stable aqueous dispersion. This polymer is a vinyl acetate/butyl acetate copolymer. The solids content of this composition is 10% by weight.

The sheet is dried.

Step 2, of impregnation with the thermosetting resin, and step 3, of lamination, are then carried out as in Example 1.

Example 5

Step 1: A sheet of paper based on step 1 of Example 1 is repeated, but by impregnating it in a size press with an aqueous composition which includes a mixture of an aqueous dispersion of a water-insoluble polymer having a hydrophilic character, known as a binder, and of an aqueous solution of poly(vinyl alcohol). This water-insoluble polymer is a copolymer of acrylic esters (ethyl acetate/acrylonitrile/-methacrylate copolymer). The solids content of this composition is 10% by weight.

The solids content of this composition comprises 10% by weight of the said water-soluble polymer and 90% by weight of the said water-insoluble polymer.

The sheet is dried.

Step 2, of impregnation with the thermosetting resin, and step 3, of lamination, are then carried out as in Example 1.

Comparative Example 6

Step 1: A sheet of paper based on step 1 of Example 1 is repeated, but by impregnating it in a size press with an aqueous composition which includes a polymer having a very hydrophilic character. This is a poly(vinyl alcohol) in aqueous solution. The solids content of this composition is 10% by weight.

The sheet is dried.

Steps 2 and 3 are carried out as in Example 1.

In this example, it was not possible to decrease the resin requirement. The 60-second Cobb water absorption value of the sheet is greater than its grammage and is higher than the $COBB_{60}$ of the control.

Results

The data and results of the tests relating to these Examples 1 to 6 are given in Table 1.

These examples show that, for a constant titanium dioxide content per square metre, the papers impregnated with a polymer which decreases the 60-second Cobb water absorption value of the sheet, determined according to the ISO 535 standard, by at most only 40% with respect to the grammage of the sheet, and more particularly by at most only 35% with respect to the 60-second Cobb water absorption value of the same sheet not yet impregnated with the said polymer, have a decreased resin requirement compared with the untreated control paper, that their opacity in laminated panel is superior to the control and that the appearance of the laminate obtained is not impaired.

Control Example 7 and Example 8

Example 8 is produced according to Example 3 with the same aqueous composition of the hydrophilic vinyl acetate/ethylene copolymer and the poly(vinyl alcohol) polymer.

Control Example 7 is a paper produced under the conditions of Example 1.

The data and the results of the tests relating to these examples are given in Table 2.

Moreover, it has been verified that the abrasion resistance of the laminate according to Example 8 treated with a hydrophilic polymer is not, or is only very slightly, impaired. It way also verified that no cracks appear on the surface of the laminate and that the laminate has a good tear strength.

Example 8 treated with a hydrophilic polymer shows that the resin requirement is reduced in the case of the sheet treated with a hydrophilic polymer compared with the untreated sheet, the opacity having moreover been improved.

Comparison between Example 8 treated with the hydrophilic polymer and Control Example 7 shows that, for a comparable grammage, less titanium dioxide per square metre is used while still having comparable opacity.

The treatment with the hydrophilic polymer therefore makes it possible to reduce the resin requirement of a sheet and the titanium dioxide content, while still obtaining a decoration film having good opacity after lamination and a laminate of uniform appearance. Moreover, the surface resistance properties of the laminate remained at a good level.

Description and Operating Conditions of the Tests

The grammage of the sheets is determined according to the ISO 536 standard after conditioning them according to the ISO 187 standard. This is the grammage of the sheet treated with the said polymer, but before impregnation with the resin.

The 60-second Cobb water absorption value, or $COBB_{60}$ Value value , is determined according to the ISO 535 standard (1 minute, water, 23° C.).

Δ ($COBB_{60}$ VALUE- grammage), expressed as a percentage, corresponds to the difference between the COBB60 VALUE of a specimen and the grammage of the same specimen, divided by this grammage.

Δ ($COBB_{66}$ VALUE- control), expressed as a percentage, corresponds to the difference between the $COBB_{60}$ VALUE of a specimen, before and after treatment with the said polymer, divided by the $COBB_{60}$ VALUE of the untreated sheet (control).

The uptake is the dry uptake, i.e. the amount of the composition of the said polymer with which the sheet has been impregnated, this being expressed by dry weight of the composition (in grams) per square metre of the sheet.

The air permeance (Gurley porosity method) is determined according to the ISO 5636-5R (1990) standard.

The resin requirement is the amount of thermosetting resin necessary to be introduced into the sheet in order to obtain, after lamination to a board, a rating of greater than or equal to 4.5 in a graphite test. This requirement is expressed as a percentage and represents the ratio of the weight of thermosetting resin absorbed to the weight of the resin-impregnated sheet, the resin containing 6.5% of volatiles.

The 800° C. ash content is determined according to French Standard NF-Q-03.047 (November 1971).

The following tests are carried out on the decoration film (resin-impregnated sheet) laminated to a particleboard:

the graphite test is carried out as follows: powered graphite is mixed with an oil so as to form a paste. This paste is spread onto the visible side of the decoration film. Next, the panel is washed with a wet sponge impregnated with a detergent. The cleaned surface is compared with a control scale. The scale goes from 1 to 6, the lowest rating being 1. It is estimated that the minimum acceptable rating is 4.5.

This graphite test makes it possible to determine the porosity of the decoration film after lamination and therefore its resistance to soiling. This property depends on several parameters, including the amount of volatiles in the resin, the lamination and the decorative sheet. The present invention provides laminates having a rating of at least 5 on the graphite test scale.

The opacity is determined on the visible side of the decoration film as follows: the reflection coefficient $R_0$ of the laminated decorative film and the reflection coefficient $R_\infty$ of four films laminated to the panel giving total opacity are measured on an ELREPHO 2000 spectrophotometer under illuminant C and at an angle of observation of 10 degrees. The opacity of the specimen is given by the ratio of these two coefficients, $R_0/R_\infty$, and is expressed as a percentage.

The present invention provides decorative sheets having an opacity of greater than or equal to approximately 90%.

The appearance of the laminate is assessed visually on a scale from 1 to 5, the rating 1 corresponding to a very poor (spotted) appearance and the rating 5 corresponding to a perfectly uniform appearance. The present invention provides laminates with an appearance having a rating of greater than or equal to 3.5.

The lightfastness, determined according to the ISO 4586-2.16 standard, is based on the scale of blues. The present invention provides decorative sheets which, once laminated, have a lightfastness of greater than or equal to 6 on the scale of blues.

The steam test, carried out according to the BS 7331 standard, is based on a scale of ratings from 1 to 5, the rating 1 corresponding to the presence of blisters and the rating 5 corresponding to no change. The present invention provides decorative sheets with a rating of greater than or equal to 3.

The crack test is carried out according to the NF-B-51281 standard; after accelerated ageing at 70° C. for 24 hours, a check is made to see whether cracks have appeared.

The tear test is carried out according to the NF-B-51283 standard.

The TABER abrasion resistance of the laminate is determined according to the NF-EN-483-2 standard.

The abrasion resistance of the laminates according to the invention is not impaired or only very slightly impaired. No cracks appear on their surface and they have a good tear strength.

TABLE 1

| | Comparative (Control) Example 1 | Comparative Example 2 | Example 3 | Example 4 | Example 5 | Comparative Example 6 |
|---|---|---|---|---|---|---|
| uptake ($g/m^2$) | 0 | 6 | 4.5 | 5 | 5 | 5.2 |
| grammage ($g/m^2$) | 72 | 78 | 76.5 | 77 | 77 | 77.2 |
| thickness ($\mu m$) | 86 | 88 | 90 | 87.5 | 86.5 | 92 |
| Gurley porosity (s) | 20 | 81 | 77 | 36 | 52 | 21 |
| $COBB_{60}$ VALUE ($g/m^2$) | 73 | 29 | 52 | 48 | 50 | 80 |
| Δ ($COBB_{60}$-grammage) (%) | +1.3 | −62.8 | −32.0 | −37.7 | −35.0 | +3.6 |
| Δ ($COBB_{60}$-control) (%) | 0 | −60 | −28.7 | −34.2 | −31.5 | +9.5 |
| $TiO_2$ content ($g/m^2$) | 29.5 | 29.5 | 29.5 | 29.5 | 29.5 | 29.5 |
| Ash content (%) | 41 | 37.8 | 38.5 | 38.3 | 38.3 | 38.2 |
| resin requirement (%) | 53 | 43 | 49 | 46 | 49 | 53 |
| Graphite test (decoration side) | 4.5 | 5 | 5 | 5 | 5 | 5 |
| Opacity on panel (%) | 90.5 | 96.3 | 93.2 | 94.5 | 93.5 | — |
| Appearance of the laminate | 4 | 2 | 4 | 3.5 | 4 | — |
| Lightfastness | ≧6 | ≧6 | ≧6 | ≧6 | ≧6 | — |
| Steam resistance | 5 | 3 | 4 | 3 | 4 | — |

TABLE 2

| | Example 7 (control) | Example 8 | |
|---|---|---|---|
| uptake ($g/m^2$) | 0 | 0 | 5.6 |
| grammage ($g/m^2$) | 80 | 74.7 | 78.9 |
| thickness ($\mu m$) | 118 | 115 | 111 |
| average Gurley porosity (s) | 16 | 12.3 | 30 |
| ash content (%) | 40 | 34.2 | 32.7 |
| titanium dioxide content ($g/m^2$) | 32 | 25.5 | 25.8 |
| resin requirement (%) | 55 | 55 | 49 |
| opacity on panel (%) | 90 | 87.9 | 89.9 |

What is claimed is:

1. A decorative paper sheet which absorbs thermosetting resin, comprising from 5 to 50% of decorative particles and/or of pigmentary colorants or organic dyes and/or of opacifying fillers, by dry weight with respect to the sheet; said sheet being impregnated with a hydrophilic polymer in an amount whereby the 60-second Cobb water absorption value of the sheet according to the ISO 535 standard, is reduced to a value which is less than the grammage of the said sheet by at most 40%.

2. The decorative sheet according to claim 1, wherein the value of the said $COBB_{60}$ VALUE is reduced to a value which is at least 5% less than the grammage of the said sheet.

3. The decorative sheet according to claim 2, wherein the value of the said $COBB_{60}$ VALUE is reduced to a value which is from 10 to 35% less than the grammage of the said sheet.

4. The decorative sheet according to claim 1, which comprises from 4 to 20% by dry weight of said polymer(s) with respect to the weight of the sheet.

5. The decorative sheet according to claim 1, wherein the grammage of the sheet is from 50 to 150 $g/m^2$.

6. The decorative sheet according to claim 1, which comprises a water-insoluble polymer having a hydrophilic character.

7. The decorative sheet according to claim 1, wherein said polymer comprises a composition of two polymers having a hydrophilic character, comprising from 95 to 80% by dry weight of a water-insoluble polymer and from 5 to 20% by dry weight of a water-soluble polymer.

8. The sheet according to claim 7, wherein said water-soluble polymer is poly (vinyl alcohol).

9. The decorative sheet according to claim 6, wherein said water-insoluble polymers having a hydrophilic character are chosen from among vinyl acetate polymers, vinyl acetate copolymers, copolymers of acrylic esters, and blends thereof.

10. The decorative sheet according to claim 9, wherein said polymers are chosen from among vinyl acetate/butyl acetate copolymers, vinyl acetate/ethylene copolymers and ethyl acetate/acrylonitrile/methacrylate copolymers.

11. The decorative sheet according to claim 1, wherein opacifying fillers are titanium dioxide pigments and that they are present in an amount of 20 to 45% by dry weight with respect to the weight of the sheet.

12. The decorative sheet according to claim 1, wherein the titanium dioxide content is from 30 to 40% by dry weight with respect to the weight of the sheet.

13. The decorative sheet according to claim 1, which comprises cellulose fibres, the cellulose fibres being split between from 40 to 100%, by weight of short fibres and from 0 to 60%, by weight of long fibres, from 0.2 to 1%, by dry weight with respect to the weight of the sheet of a wet-strength agent.

14. A decorative paper sheet impregnated with a partially crosslinked thermosetting resin, which comprises a paper sheet according to claim 1.

15. The decorative sheet according to claim 14, which comprises at most 50% by weight of thermosetting resin with respect to the weight of the resin-impregnated sheet, volatile compounds included.

16. The sheet according to claim 14, wherein said resin is chosen from among melamine-formaldehyde resins, urea-formaldehyde resins, benzoguanamine-formaldehyde resins, unsaturated polyester resins and blends thereof.

17. The sheet according to claim 15, which comprises at least 40%, by weight of resin with respect to the weight of the resin-impregnated sheet, volatile compounds included.

18. A process for manufacturing, by wet route, a decorative sheet according to claim 1, which comprises the following steps:

a sheet is formed on a papermaking machine from an aqueous suspension of cellulose fibres, and optionally of synthetic fibres, and from 5 to 50% of decorative particles and/or of pigmentary colorants or organic dyes and/or of opacifying fillers, by dry weight with respect to the sheet and optionally of other additives usually employed in these sheets, the sheet is drained and, optionally, dried, the sheet formed is impregnated, using a size press, with a composition in aqueous medium containing one or more of said polymers, the sheet is drained and dried.

19. The process according to claim 18, which comprises the following steps:

a sheet is formed on a papermaking machine from an aqueous suspension of cellulose fibres, these fibres being split between from 40 to 100%, by weight of short fibres and from 0 to 60%, by weight of long fibres, from 0.2 to 1%, by dry weight with respect to the sheet of a wet-strength agent and from 5 to 50% of decorative particles and/or pigmentary colorants or organic dyes and/or opacifying fillers, by dry weight with respect to the sheet and optionally of other additives usually employed in these sheets, the sheet is drained and, optionally, dried, the sheet formed is impregnated, using a size press, with from 4 to 20% by dry weight with respect to the sheet, of a composition in aqueous medium containing one or more of said polymers having a hydrophilic character, the solids content of the composition being between 5 and 20% by weight, the sheet is drained and dried.

20. A process for manufacturing a decorative sheet impregnated with a partially crosslinked thermosetting resin according to claim 14, wherein said sheet is impregnated with a thermosetting resin and the resin is partially crosslinked, the content of volatile compounds being between 5 and 8% by weight of the sheet.

21. A laminated decorative panel or profile, which comprises, as decorative sheet, a sheet according to claim 1.

22. The laminated decorative panel or profile according to claim 21, which is a low-pressure laminate.

23. The laminated decorative panel or profile according to claim 21, having a lightfastness which is greater than or equal to 6 on the scale of blues according to the ISO 4586-2.16 standard.

24. The decorative paper sheet of claim 1 which includes titanium dioxide as an opacifying filler.

25. The decorative sheet of claim 4 wherein said polymer (s) is present in an amount of from 2 to 10 g by dry weight of said polymer(s) per square meter of said sheet.

26. The decorative sheet of claim 5 wherein the grammage of said sheet is from 60 to 100 g/m$^2$.

27. The decorative sheet of claim 13 wherein said short fibers are present in an amount from 80 to 100% by weight and the long fibers are present in an amount of from 0 to 20% by weight and said wet-strength agent is present in an amount of from 0.4 to 0.5%, said amount being by dry weight with respect to the weight of the sheet.

28. The sheet of claim 17 which comprises at least 45% by weight of resin with respect to the weight of the resin-impregnated sheet, volatile compounds included.

29. The process of claim 18 wherein titanium dioxide is used as an opacifying filler.

30. The process of claim 18 which comprises the following steps:

a sheet is formed on a papermaking machine from an aqueous suspension of cellulose fibers, these fibers being split between from 80 to 100%, by weight of short fibers and from 0 to 20%, by weight of long fibers, from 0.4 to 0.5%, by dry weight with respect to the sheet of a wet-strength agent and from 5 to 50% of decorative particles and/or pigmentary colorants or organic dyes and/or titanium dioxide as an opacifying filler, by dry weight with respect to the sheet and optionally of other additives usually employed in these sheets;

the sheet is drained and, optionally, dried;

the sheet formed is impregnated, using a size press, with from 2 to 10 g/m$^2$ by dry weight, of a composition in aqueous medium containing one or more of said polymers having a hydrophilic character, the solids content of the composition being between 5 and 20% by weight;

the sheet is drained and dried.

31. A decorative paper sheet which absorbs thermosetting resin, comprising from 5 to 50% of decorative particles and/or of pigmentary colorants or organic dyes and/or of opacifying fillers, by dry weight with respect to the sheet, wherein said sheet has a 60-second Cobb water absorption value according to the ISO 535 standard and said sheet comprises a composition of at least one polymer having a hydrophilic character impregnated therein in an amount which reduces said 60-second Cobb water absorption value by no more than 35%.

32. The decorative sheet according to claim 3, wherein said $COBB_{60}$ VALUE is reduced by at least 5%.

33. The decorative paper sheet of claim 31 which includes titanium dioxide as an opacifying filler.

34. A white decorative paper sheet impregnated with a partially crosslinked thermosetting resin, wherein said sheet comprises at most 50% by weight of thermosetting resin with respect to the weight of the resin-impregnated sheet, volatile compounds included, and a titanium dioxide content of less than 40%, and having an opacity identical to that of a decorative sheet of the same grammage before impregnation by the said resin and containing at least 40% of titanium dioxide and at most 50% of said resin.

35. The white decorative sheet of claim 34 which has a titanium dioxide content of less than 35% and said white decorative sheet has an opacity which is identical to the opacity of a decorative sheet of the same grammage before impregnation by said resin and which contains at least 40% of titanium dioxide and at most 50% of said resin.

36. The sheet according to claim 34, wherein said resin is chosen from among melamine-formaldehyde resins, urea-formaldehyde resins, benzoguanamine-formaldehyde resins, unsaturated polyester resins and blends thereof.

37. The sheet according to claim 34, which comprises at least 40%, by weight of resin with respect to the weight of the resin-impregnated sheet, volatile compounds included.

* * * * *